US007425128B2

(12) United States Patent
Gjerde et al.

(10) Patent No.: US 7,425,128 B2
(45) Date of Patent: Sep. 16, 2008

(54) ROTARY ACTUATED REED SWITCH CONTROL

(75) Inventors: Richard D. Gjerde, Braceville, IL (US); Robert Dam, Aurora, IL (US); Massimo Aleardi, Cassano Magnago (IT)

(73) Assignee: Illinois Tool Works Inc., Glenview, IL (US)

( * ) Notice: Subject to any disclaimer, the term of this patent is extended or adjusted under 35 U.S.C. 154(b) by 52 days.

(21) Appl. No.: 11/788,568

(22) Filed: Apr. 20, 2007

(65) Prior Publication Data

US 2008/0003532 A1 Jan. 3, 2008

Related U.S. Application Data

(60) Provisional application No. 60/817,388, filed on Jun. 29, 2006.

(51) Int. Cl.
*F23Q 3/00* (2006.01)

(52) U.S. Cl. ..... 431/278; 431/254; 431/256; 335/206; 335/162; 335/163

(58) Field of Classification Search ..... 431/278, 431/254, 256; 335/206, 162, 163
See application file for complete search history.

(56) References Cited

U.S. PATENT DOCUMENTS

| | | | | |
|---|---|---|---|---|
| 4,160,900 | A * | 7/1979 | Carol, Jr. | 235/132 E |
| 5,357,067 | A * | 10/1994 | Keck | 200/19.26 |
| 5,525,771 | A * | 6/1996 | Lund | 200/61.86 |
| 6,446,622 | B1 | 9/2002 | Home | |
| 2004/0118666 | A1 * | 6/2004 | McCaig et al. | 200/38 F |

* cited by examiner

*Primary Examiner*—Steven B. McAllister
*Assistant Examiner*—Nikhil Mashruwala
(74) *Attorney, Agent, or Firm*—Mark W. Croll; Paul F. Donovan

(57) ABSTRACT

A gas appliance control assembly includes a gas valve and a reed switch operated simultaneously by rotation of a single shaft. The reed switch opens and closes a circuit including an electronic ignition module and a spark igniter so that spark is provided as the gas valve is adjusted to a burner igniting condition.

20 Claims, 4 Drawing Sheets

ROTARY ACTUATED REED SWITCH CONTROL

CROSS-REFERENCE TO RELATED APPLICATIONS

The present regular United States Patent Application claims the benefits of U.S. Provisional Application Ser. No. 60/817,388, filed on Jun. 29, 2006.

FIELD OF THE INVENTION

The present application relates generally to switch mechanisms and, more particularly, to igniter switches for gas cooking appliances. Most specifically, the present invention relates to switch mechanisms useful for outdoor applications as actuating switches for igniters of gas cooking appliances.

BACKGROUND OF THE INVENTION

Gas cooking appliances are known to have a manifold assembly made of metal tubing or pipes that directs gas from a main gas source to the individual burners. The manifold includes one gas valve for each burner. When cooking, the consumer controls the flow of gas, and hence the levels of the cooking flame by manually adjusting the gas valve for a particular burner. The valve is fitted with a plastic knob or handle of some sort to facilitate the consumer interface with the valve.

To begin the cooking process, the flow of gas must be started and then ignited immediately. In the past, the gas was ignited simply with a match or other open flame source. Thereafter, gas cooking ranges were provided with a standing pilot light that automatically ignited the gas at the burner when the gas flow reached the burner. More recently, cooking appliances have been provided with electronic ignition systems to ignite the gas. Electronic ignition systems are used to ignite gas at the burners of gas cooking appliances without the inconvenience of hand lighting with a match or other ignition source. Electronic ignition modules also avoid the wastefulness of standing pilot lights that consume fuel when a burner is not in use. In an electronic ignition system, a spark igniter initiates a spark or series of sparks at the same time as gas flow is initiated to the burner assembly.

When a gas appliance is used for indoor or weather-protected installations, known electronic gas ignition systems using spark igniters, electronic ignition modules and switch harnesses have been used effectively. However, it is desirable to have similar convenience for igniting outdoor gas cooking appliances, and known ignition modules and switch harnesses have not provided sufficient weather resistance for prolonged outdoor use.

Basic reed switches are known. A reed switch can have switch contacts in an enclosed glass or other weatherproof housing. The reed switch contacts are opened and closed through the manipulation of a magnet, which causes the switch elements to be magnetized and contact one another or to be non-magnetized and separate from on another. It is known to use the basic principles of a reed switch in a rotary operating condition such that the switch can be moved from an open condition to a closed condition by rotating a knob containing a magnet therein in close proximity to the vessel containing the reed switch contacts.

A problem with known rotary actuated reed switches is that the switch contacts are close to the surface of the appliance so that the control knob containing the magnet is in close proximity thereto. It is known to use magnets in other accessories, such as note and recipe card holders, outdoor accessory lights for cooking grills, utensil holders and the like. If an accessory containing a magnet of sufficient strength is placed near the control knob containing the magnet for the reed switch, the reed switch can be actuated inadvertently by the magnet on the accessory, or the magnet on the accessory can interfere with the proper operation of the reed switch through rotation of the control knob. Further, the magnet can be dislodged or lost when the control knob is removed for cleaning. If the knob is damaged and requires replacements, the consumers options for a replacement part are limited if operation of the reed switch is to be maintained.

SUMMARY OF THE INVENTION

The present invention provides a remote actuated reed switch associated with a gas flow control valve for a gas cooking appliance in which a magnet slides within a channel guided in movement by a curved slot of a rotary actuator to move the reed switch from an open condition to a closed condition and back to an open condition appropriate for the gas flow control moving from a closed condition through an igniter position and to various positions for controlling gas flow and flame conditions.

In one aspect thereof, the present invention provides a gas appliance control assembly with a gas valve having a rotatable valve shaft and a reed switch having first and second reed switch contacts and a magnet movable relative to the first and second contacts. The reed switch includes a reed switch body defining a substantially straight channel and a reed switch rotary element having a cam track. The rotary element is associated with the valve shaft for rotation therewith, and is associated with the reed switch body for relative rotation thereto upon rotation of the valve shaft. The magnet is disposed partly in the channel and partly in the cam track.

In another aspect thereof, the present invention provides a gas appliance control assembly with a gas valve having an inlet, an outlet and a rotatable valve shaft and a reed switch in proximity to the gas valve. The valve shaft extends through the reed switch. The reed switch includes a reed switch body, a rotary switch element, first and second contacts, and a magnet movable relative to the contacts for opening and closing the contacts. The rotary switch element is associated with the valve shaft for co-rotation therewith and with the reed switch body and the first and second contacts for relative rotation with respect thereto. A substantially straight channel is defined in the reed switch body, and a cam track is defined in the rotary switch element. The magnet is disposed partly in the channel and partly in the cam track to traverse the channel and the track upon rotation of the valve shaft.

In a still further aspect thereof, the present invention provides a gas appliance with a burner assembly and a control assembly. The control assembly includes a gas valve controlling gas flow to the burner assembly, an electronic ignition module and a spark igniter electrically connected to the electronic ignition module and a reed switch electrically connected to the electronic ignition module. The reed switch has first and second switch contacts, a magnet movable relative to the first and second switch contacts, a fixed switch body, and a rotatable switch element. A valve shaft extends through the reed switch and adjustably controls gas flow through the gas valve upon rotation of the shaft. A gas manifold is in flow communication with the gas valve. A gas line connects the gas valve to the burner assembly. The rotatable switch element is secured to the valve shaft for co-rotation therewith, and defining a cam track. The fixed switch body defines a substantially straight channel. The magnet is disposed partly in the cam track and partly in the substantially straight channel.

An advantage of the present invention, in one form thereof, is providing a substantially weatherproof switch for an electronic igniter system on gas appliances.

Another advantage of the present invention, in another form thereof, is providing a remote operated switch in close proximity to an associated gas control valve for operating gas fired appliances.

Still another advantage of the present invention, in yet another form thereof, is providing a reed switch protected from inadvertent manipulation by extraneous magnets used around the appliance having the reed control switch.

Still another advantage of the present invention, in still another form thereof, is providing a reed switch and gas valve control assembly mechanism that can be used indoors and outdoors on a variety of appliances and devices.

Other features and advantages of the invention will become apparent to those skilled in the art upon review of the following detailed description, claims and drawings in which like numerals are used to designate like features.

Figure 1:
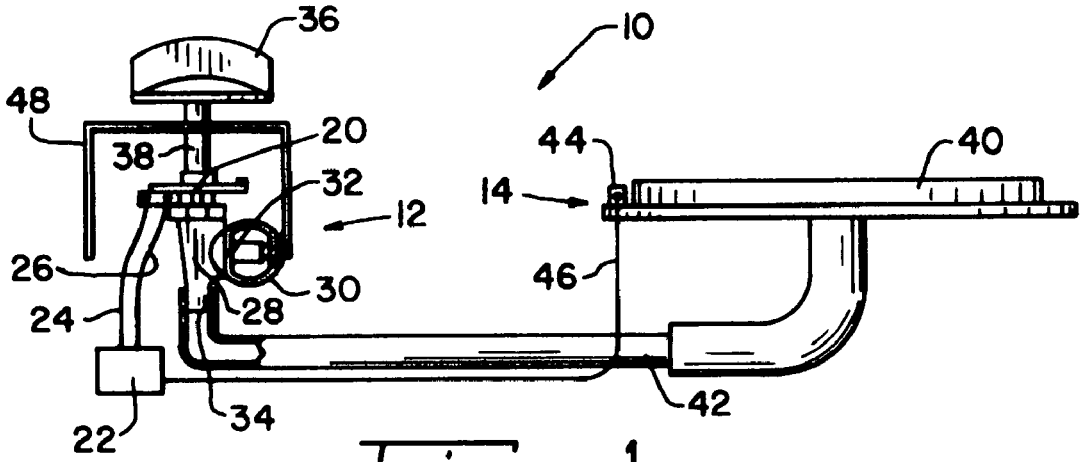
FIG. 1 is an elevational view, in partial cross-section, of a gas fired appliance having a control assembly in accordance with the present invention, including a reed switch and a gas valve operatively controlled in unison.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, a gas fired appliance 10 is shown having a control assembly 12 in accordance with the present invention for operating a gas burner assembly 14. Control assembly 12 regulates gas flow to burner assembly 14 and initiates an ignition spark to ignite the gas at burner assembly 14 when the flow of gas is initiated.

Control assembly 12 includes a reed switch 20 operatively connected to an electronic ignition module 22 by main conductors 24, 26. Control assembly 12 further includes a known gas valve 28 for controlling flow of gas from a gas manifold 30 to burner assembly 14, and includes a gas valve inlet 32 in flow communication with manifold 30 and a gas valve outlet 34 in flow communication with burner assembly 14. Reed switch 20 and gas valve 28 are controlled jointly by rotation of a control knob 36 connected to, for rotation of a valve shaft 38. Rotation of shaft 38 operates reed switch 20, as will be described more fully hereinafter, and adjusts also the opening and closing of gas valve 28 to control the flow of gas, as those skilled in the art will readily understand.

Burner assembly 14 includes a gas burner 40 receiving gas flow from gas valve 28 via a gas line 42 connected to outlet 34 and burner 40. A spark igniter 44 is associated with gas burner 40 for igniting gas emitted from burner 40. Spark igniter 44 is connected to electronic ignition module 22 by a conductor 46. Electronic ignition module 22 and spark igniter 44 are of known design understood by those skilled in the art and will not be described in further detail herein. Upon activation by closing reed switch 20, electronic ignition module 22 supplies an electrical impulse to spark igniter 44 in close proximity to burner 40. The spark or sparks emitted from spark igniter 44 ignite gas flowing from gas burner 40 to initiate a flame at burner 40.

Figure 2:
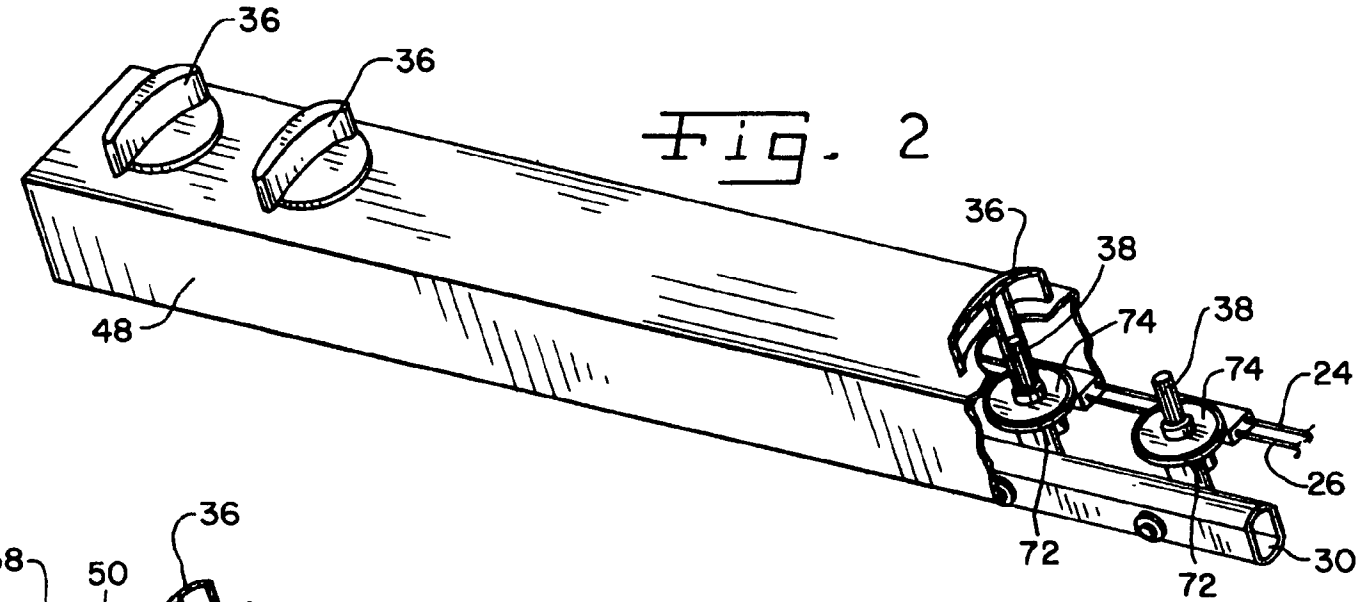
FIG. 2 is a perspective view of a control assembly of the present invention having multiple reed switches and gas valves operatively associated.
Figure 3:
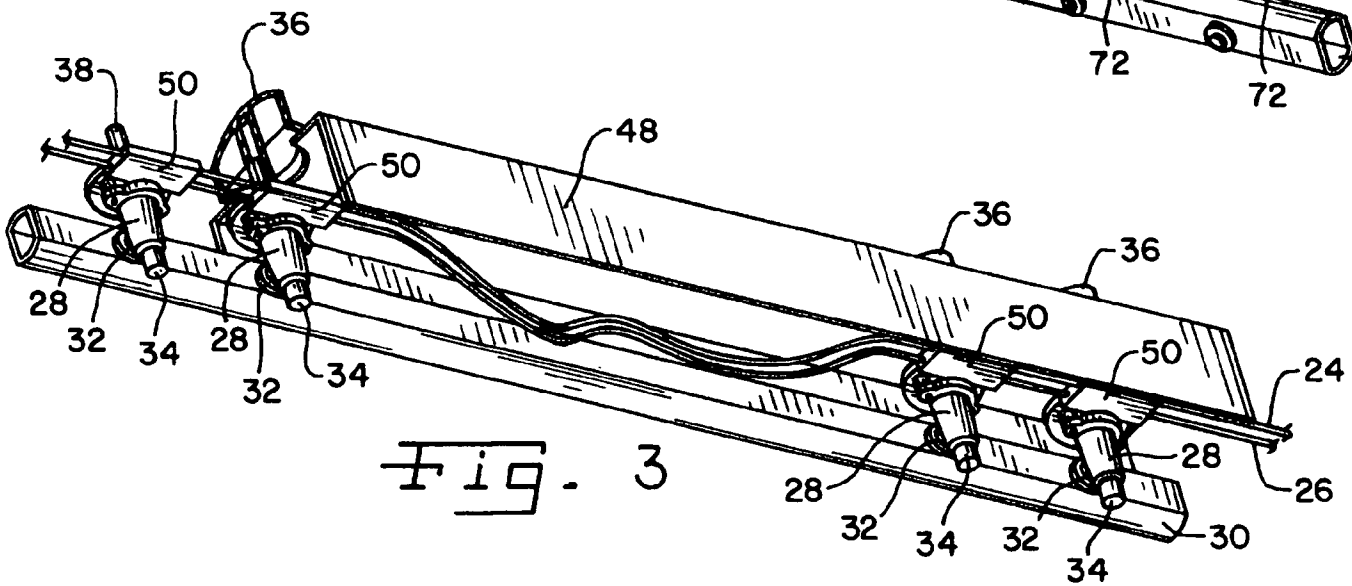
FIG. 3 is a perspective view of the control assembly shown in FIG. 2, but showing the bottom or underside of the assembly.

As shown in FIGS. 2 and 3, control assembly 12 can include multiple reed switches 20 each associated with a different gas valve 28 to control multiple burners 40 of an appliance 10. Each reed switch 20 is connected electrically to main conductors 24, 26; and each gas valve 28 is operatively associated with gas manifold 30 for directing gas flow from manifold 30 to an appropriate burner for combustion. The assemblies of a reed switch 20 with an associated gas valve 28 are contained in a housing 48 through which shafts 38 extend. A control knob 36 is provided on each shaft 38 exteriorly of housing 48.

Figure 8:
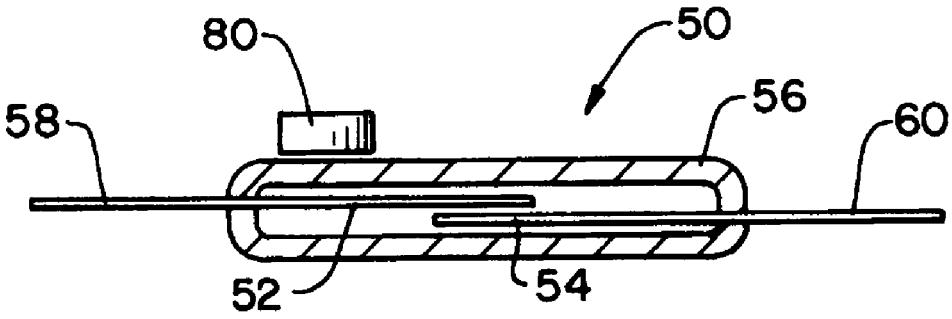
FIG. 8 is a schematic illustration of a reed switch in a contacts open condition.
Figure 9:
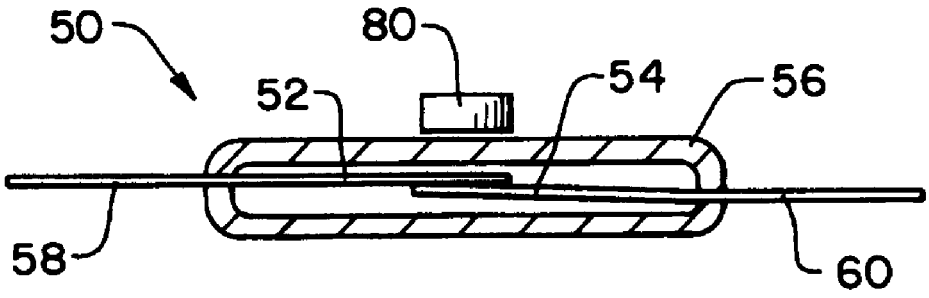
FIG. 9 is a schematic illustration of a reed switch in a contacts closed condition.

As shown in FIGS. 8 and 9, reed switch 20 includes a contacts module 50 having first and second contacts 52 and 54 enclosed in a glass or other environmentally sealed tube or case 56. Contacts 52 and 54 are electrically connected to external switch conductors 58 and 60 extending out of case 56. External switch conductors 58 and 60 are connected electrically to conductors 24 and 26 described previously, which are electrically connected to electronic ignition module 22 which contains or is connected to a source of electric power (not shown). Closing contacts 52 and 54 completes a circuit including ignition module 22 and spark igniter 44 to initiate the aforedescribed impulse to igniter 44 to generate ignition sparks at burner assembly 14. Opening contacts 52 and 54 interrupts the circuit and terminates spark generation at igniter 44.

Figure 4:
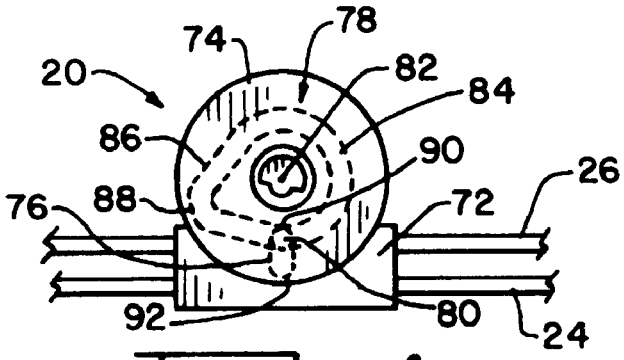
FIG. 4 is a top view of a reed switch in accordance with the present invention shown in an open switch condition.
Figure 5:
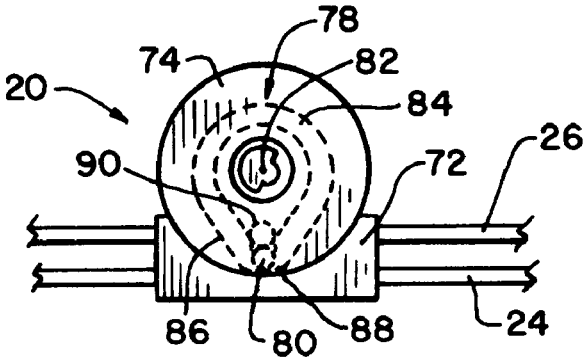
FIG. 5 is a top view similar to that of FIG. 4, but illustrating the reed switch in a switch closed condition.

FIGS. 4 and 5 illustrate an embodiment of reed switch 20 of the present invention in a contacts opened condition and a contacts closed condition, respectively. Switch 20 includes a switch body 72 and a rotary switch element 74, which can be made of plastic or other suitable material. Valve shaft 38 extends through switch 20, with switch body 72 being arranged to remain stationary as shaft 38 is rotated, and rotary switch element 74 being associated with shaft 38 for rotation therewith. Accordingly, as shaft 38 is rotated, rotary switch element 74 rotates relative to switch body 72.

Switch body 72 defines a substantially straight slot or channel 76. Rotary switch element 74 defines a cam track or continuous path 78 having a tear drop shape. For illustrative purposes, channel 76 and cam track 78 are depicted in dotted lines in FIGS. 4 and 5 to better show the relative positioning of one with respect to the other as rotary switch element 74 is rotated. When switch body 72 and rotary switch element 74 are formed of clear plastic, the peripheral edge portions of channel 76 and cam track 78 are visible through the thicknesses thereof, as shown by the dotted lines in FIGS. 4 and 5.

A magnet 80 is disposed partly in channel 76 and partly in continuous path 78. As rotary switch element 74 is rotated and magnet 80 is caused to follow continuous path 78, due to the shape of continuous path 78, magnet 80 is caused also to slide along substantially straight channel 76.

Rotary switch element 74 rotates about an axis 82 defined within teardrop shaped continuous path 78. A substantially circular portion 84 of continuous path 78 defines an area of substantially continuous and consistent distance from axis 82. A tapered, narrowing portion 86 of general v-shape defines an apex 88 of greater distance from axis 82 then portion 84. Accordingly, as a magnet 80 moves into or away from apex 88 in continuous path 78, magnet 80 also moves along channel 76 in switch body 72. As magnet 80 traverses substantially circular portion 84 of continuous path 78 magnet 80 remains at an end 90 of channel 76 so that reed switch 20 is in an open condition. When magnet 80 is near or in apex 88, magnet 80 is at an opposite end 92 of channel 76 such that reed switch 20 is closed. The relationship between a position of magnet 80 and the closed or opened contacts position in that reed switch 20 is illustrated schematically in FIGS. 8 and 9.

Rotary switch element 74 can be coordinated with gas valve 28 such that portion 86 coordinates with the gas valve positioning when gas flow is at a flow condition for igniting. Substantially circular portion 84 of continuous path 78 coordinates with the gas valve in an off position on one side of tapered narrowing portion 86, and with continuously adjustable positions for controlled gas flow between the various desired flame intensities on the other side of tapered narrowing portion 86. Accordingly, magnet 80 is held in position such that switch 20 is open when gas flow is off. Magnet 80 moves toward a position such that switch 20 closes as gas flow is initiated for ignition. Thereafter, when ignition is complete and the flame is adjusted between low and high conditions, magnet 80 is again moved in channel 76 such that switch 20 opens.

Figure 6:
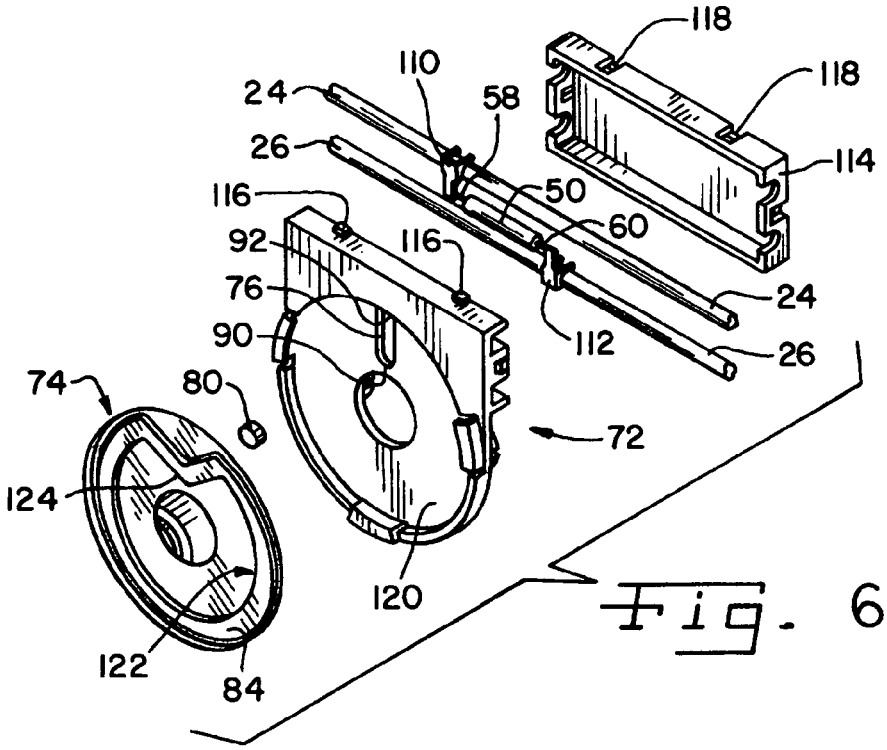
FIG. 6 is an exploded view of a reed switch in accordance with the present invention, illustrated from one angle.
Figure 7:
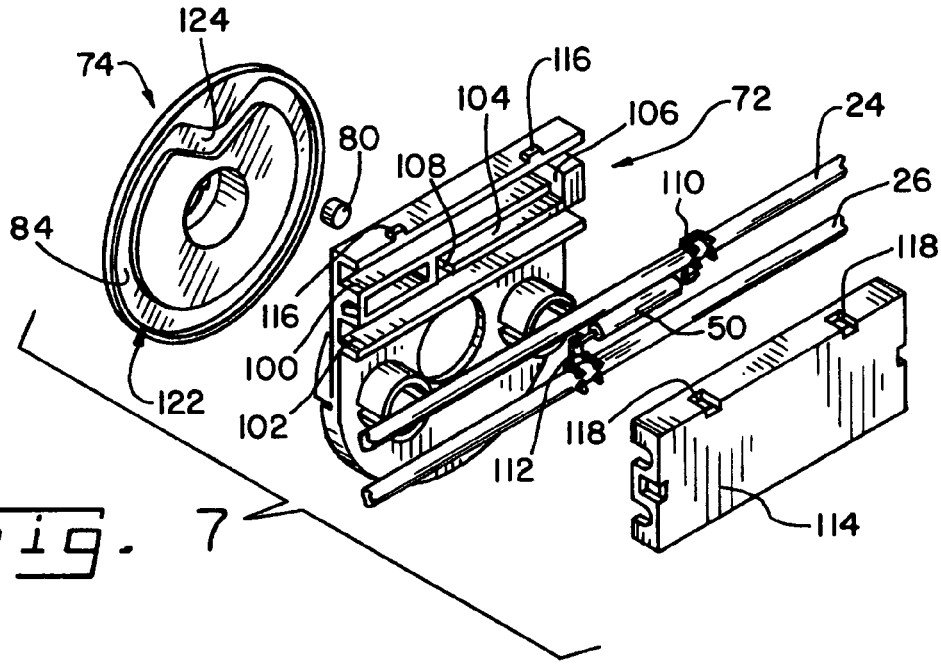
FIG. 7 is an exploded view of the reed switch shown in FIG. 6, illustrated from angle different from that shown in FIG. 6.

FIGS. 6 and 7 are exploded views, in greater detail, of reed switch 20. Switch body 72 defines troughs 100, 102 for receiving conductors 24 and 26 respectively. A slot 104 holds contacts module 50. Passages 106, 108 are substantially perpendicular to troughs 100, 102 and slot 104 to hold connectors 110, 112 that connect external switch conductors 58, 60 to main conductors 24, 26. A cover 114 snaps on to switch body 72 and is held thereon via tabs 116 on switch body 72 received in holes 118 in cover 114. Rotary switch element 74 is rotatably held in a shallow well portion 120 of switch body 72, with channel 76 provided in the bottom of well portion 120.

Rotary switch element 74 defines a cam track or continuous path 122 somewhat differently shaped than cam track 78. Magnet 80 is disposed partly in channel 76 and partly in cam track 122.

A substantially circular portion 84 is provided in cam track 122 and defines an area of substantially continuous and consistent distance from axis 82. A tapered, narrowing portion 124 of general v-shape defines a path of smaller distance from axis 82 than a distance between axis 82 and circular portion 84. Accordingly, as a magnet 80 moves into or out of portion 124, magnet 80 also moves along channel 76 in switch body 72. As magnet 80 traverses substantially circular portion 84 of cam track 122, magnet 80 remains at an end 92 of channel 76 so that reed switch 20 is in a closed condition. When magnet 80 traverses portion 124, magnet 80 also traverses channel 76, between ends 90 and 92, which changes the position of magnet 80 relative to first and second contacts 52, 54. The relationship between a position of magnet 80 and the closed or opened contacts position in reed switch 20 is illustrated schematically in FIGS. 8 and 9. Alternatively, magnet 80 could be schematically shown in FIG. 8 to be located away from the case 56 in the vertical direction from the location of magnet 80 shown in FIG. 9.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A gas appliance control assembly, comprising:

a gas valve having a rotatable valve shaft;

a reed switch having first and second reed switch contacts and a magnet movable relative to said first and second contacts;

said reed switch including a reed switch body defining a substantially straight channel;

said reed switch including a reed switch rotary element having a cam track, said rotary element being associated with said valve shaft for rotation therewith, and being associated with said reed switch body for relative rotation thereto upon rotation of said valve shaft;

said magnet being disposed partly in said channel and partly in said cam track and said magnet capable of motion relative to both the cam track and the channel.

2. The control assembly of claim 1, including a contacts module having said first and second contacts therein, said module being connected to said reed switch body.

3. The control assembly of claim 2, said contacts module being sealed.

4. The control assembly of claim 2, including an electronic ignition module electrically connected to said contacts.

5. The control assembly of claim 4, said contacts module being sealed.

6. The control assembly of claim 4, including a spark igniter electrically connected to said electronic ignition module.

7. The control assembly of claim 1, said valve shaft extending through said reed switch body and said reed switch rotary element.

8. A gas appliance control assembly, comprising:

a gas valve having an inlet, an outlet and a rotatable valve shaft;

a reed switch in proximity to said gas valve;

said valve shaft extending through said reed switch;

said reed switch including a reed switch body, a rotary switch element, first and second contacts, and a magnet movable relative to said contacts for opening and closing said contacts;

said rotary switch element being associated with said valve shaft for co-rotation therewith and with said reed switch body and said first and second contacts for relative rotation with respect thereto;

a substantially straight channel defined in said reed switch body;

a cam track defined in said rotary switch element;

said magnet being disposed partly in said channel and partly in said cam track to traverse said channel and said track upon rotation of said valve shaft and said magnet capable of motion relative to both the cam track and the channel.

9. The control assembly of claim 8, including a sealed contacts module having said first and second contacts therein.

10. The control assembly of claim 9, including first and second conductors connected to said first and second contacts, and an electronic ignition module connected to said conductors.

11. The control assembly of claim 10, including a spark igniter electrically connected to said electronic ignition module.

12. The control assembly of claim 8, said cam track including a tapered portion and a part circular portion.

13. The control assembly of claim 12, said magnet retained substantially stationary at an end of said channel while traversing said part circular portion of said cam track.

14. A gas appliance, comprising:

a burner assembly and a control assembly;

said control assembly including;

a gas valve controlling gas flow to said burner assembly;

an electronic ignition module and a spark igniter electrically connected to said electronic ignition module;

a reed switch electrically connected to said electronic ignition module, said reed switch having first and second switch contacts, a magnet movable relative to said first and second switch contacts, a fixed switch body, and a rotatable switch element; and a valve shaft extending through said reed switch and adjustably controlling gas flow through said gas valve upon rotation of said shaft;

a gas manifold in flow communication with said gas valve;

a gas line connecting said gas valve to said burner assembly;

said rotatable switch element secured to said valve shaft for co-rotation therewith, and defining a cam track;

said fixed switch body defining a substantially straight channel;

said magnet being disposed partly in said cam track and partly in said substantially straight channel and said magnet capable of motion relative to both the cam track and the channel.

15. The gas appliance of claim 14, said first and second switch contacts being sealed in a case.

16. The gas appliance of claim 14, said cam track including a part circular portion, and said magnet being retained substantially stationary at an end of said channel while traversing said part circular track portion.

17. The gas appliance of claim 14, including a housing, said gas valve and said reed switch being disposed in said housing, and said valve shaft extending from said gas valve and said reed switch outwardly of said housing.

18. The gas appliance of claim 17, including a control knob secured on an end of said valve shaft exteriorly of said housing.

19. The gas appliance of claim 17, including a plurality of burner assemblies, and a different gas valve and associated reed switch provided for each of said burner assemblies.

20. The gas appliance of claim 14, including a plurality of burner assemblies, and a different gas valve and associated reed switch provided for each of said burner assemblies.

* * * * *